US010935191B2

(12) United States Patent
Zhang

(10) Patent No.: US 10,935,191 B2
(45) Date of Patent: Mar. 2, 2021

(54) LED LIGHT PANEL SYSTEM FOR RETROFITTING LIGHT TROFFERS

(71) Applicant: Kanghong Zhang, Santa Fe Springs, CA (US)

(72) Inventor: Kanghong Zhang, Santa Fe Springs, CA (US)

( * ) Notice: Subject to any disclaimer, the term of this patent is extended or adjusted under 35 U.S.C. 154(b) by 0 days.

(21) Appl. No.: 16/700,874

(22) Filed: Dec. 2, 2019

(65) Prior Publication Data

US 2020/0173612 A1 Jun. 4, 2020

Related U.S. Application Data

(60) Provisional application No. 62/774,717, filed on Dec. 3, 2018.

(51) Int. Cl.

| | |
|---|---|
| ***F21K 9/237*** | (2016.01) |
| ***F21K 9/275*** | (2016.01) |
| ***F21S 8/04*** | (2006.01) |
| ***F21V 23/06*** | (2006.01) |
| *F21Y 115/10* | (2016.01) |

(52) U.S. Cl.
CPC ..... *F21K 9/275* (2016.08); *F21S 8/043* (2013.01); *F21V 23/06* (2013.01); *F21Y 2115/10* (2016.08)

(58) Field of Classification Search
CPC ..... F21K 9/23; F21K 9/237; F21V 21/048; F21Y 2105/16
See application file for complete search history.

(56) References Cited

U.S. PATENT DOCUMENTS

| | | | | |
|---|---|---|---|---|
| 8,523,383 | B1 | 9/2013 | Grigore | |
| 9,039,251 | B2 * | 5/2015 | Howe | F21V 17/101 362/329 |
| 9,353,923 | B2 * | 5/2016 | Scribante | F21V 15/015 |
| 9,622,424 | B2 * | 4/2017 | Martin | F21V 17/10 |
| 9,897,305 | B2 * | 2/2018 | Ryder | F21V 21/048 |
| 9,989,225 | B2 * | 6/2018 | Rao | E04B 9/003 |
| 10,288,238 | B2 * | 5/2019 | Yaphe | F21V 7/05 |
| 10,364,960 | B2 * | 7/2019 | Nguyen | F21V 3/0625 |
| 10,429,018 | B2 * | 10/2019 | Werr | F21V 11/06 |
| 10,488,023 | B1 * | 11/2019 | Rao | F21V 21/048 |
| 10,539,273 | B1 * | 1/2020 | Cai | F21K 9/68 |
| 2013/0301249 | A1 * | 11/2013 | Ngai | F21S 8/026 362/147 |
| 2016/0102825 | A1 | 4/2016 | Scribante | |
| 2016/0356430 | A1 | 12/2016 | Stratas | |
| 2018/0231219 | A1 * | 8/2018 | Leung | F21K 9/272 |
| 2019/0003654 | A1 * | 1/2019 | Hayman | F21S 8/02 |

* cited by examiner

*Primary Examiner* — Ismael Negron
(74) *Attorney, Agent, or Firm* — Clement Cheng

(57) ABSTRACT

A light panel retrofit system includes an LED panel with an underside, and having LED panel lens circumscribed by an LED panel frame; a power supply is mounted to the LED panel; and an LED panel support frame configured to support the LED panel frame, and including first and second end frame members connecting first and second side rails to each other.

10 Claims, 6 Drawing Sheets

LED LIGHT PANEL SYSTEM FOR RETROFITTING LIGHT TROFFERS

This application claims priority from U.S. provisional application 62/774,717 filed Dec. 3, 2018 entitled Panel Retrofit System by Kanghong Zhang, the disclosure of which is incorporated herein by reference.

FIELD OF THE INVENTION

The present invention is in the field of LED light panel retrofits.

DISCUSSION OF RELATED ART

As traditional florescent tubing is replaced by LED lighting, a variety of LED light panel retrofit systems have been created for retrofitting light troffers. The newer designs have a variety of different structural configurations specially adapted for LED lighting.

For example, the disclosure in US patent publication number US20160102825A1 by inventor John Scribante entitled Combination Retrofit And New Construction Troffer Light Fixture Systems And Methods filed on May 31, 2016 describes, "A light fixture is configured for use in either retrofitting an existing troffer light fixture or for use in new construction. The light fixture includes a self-supporting adaptor bracket configured to rest on a T-bar of a ceiling system and further configured to optionally receive a housing of the existing troffer light fixture. The light fixture further includes a door assembly including a latch configured to engage a latch surface of the adaptor bracket, a hinge configured to interface with a slot of the adaptor bracket, a housing including the latch and the hinge, and a light source within the housing." The new LED lighting systems connect to the T-bar of the ceiling system similar to prior florescent troffers.

Also for example, the disclosure in U.S. Pat. No. 8,523,383 by inventor Valerica Grigore titled the invention Retrofitting recessed lighting fixtures that was filed on Sep. 3, 2013 describes, "A retrofit kit assembly for a recessed lighting fixture and methods for manufacturing and installing the same are described herein. The retrofit kit includes at least two mounting brackets, which can each include at least one lamp socket. The kit also includes at least one ballast, which may be pre-wired to the sockets. Each ballast may include a temporary adhesive on a mounting side thereof, for use during the installation process. For example, the installer may provisionally mount the ballast to an interior surface of an existing housing of the fixture and then permanently mount the ballast using one or more fasteners. The mounting brackets and ballast of the kit may include captive hardware which is held in place in the aperture for the fastener prior to fastening the particular object to the recessed housing, which reduces risk of dropping or losing fasteners during installation." As the new LED lighting systems are smaller and lighter, the supporting structure has changed to accommodate the new LED lighting systems.

Also for example, as described in the disclosure of patent publication US20160356430A1 by inventor Chris Stratus entitled Snap In Retrofit Panel filed on Jun. 2, 2016 describes, "A retrofit lighting fixture for retrofitting a pre-existing lighting fixture. The pre-existing lighting fixture includes electrical wiring and a troffer having a recessed center portion and an outer perimeter edge, which together form a hollow inner cavity, the electrical wiring extending into the cavity. The retrofit lighting fixture includes a lighting panel, a spring and a magnet. The lighting panel has light sources and electrical wiring. The lighting panel electrical wiring is connected to the electrical wiring of the pre-existing lighting. The spring has a first end connected to the lighting panel and a second end connected to the magnet. The magnet is attached to the recessed center portion of the troffer, and the spring is configured to pull the lighting panel against the outer perimeter edge of the troffer. In some applications the retrofit lighting fixture is a LED lighting fixture."

SUMMARY OF THE INVENTION

A light panel retrofit system includes an LED panel having LED panel lens and an LED panel frame, wherein the LED panel has an LED panel underside. The LED panel frame circumscribes the LED panel lens. A power supply is mounted to LED panel supplying power to the LED panel. An LED panel support frame is configured to support the LED panel frame. The LED panel support frame further comprises a pair of end members, namely a first end frame member and a second end frame member. The LED panel support frame further comprises a pair of side rails, namely a first side rail and a second side rail. The pair of side rails connect the pair of end members to each other.

A first panel footing is formed as a pair of footing supports, namely a right first panel footing support and a left first panel footing support. The first panel footing is connected to the LED panel frame and configured to rest upon a top surface of the LED panel support frame. The pair of side rails are preferably connected to the end frame members by slot and tab connection.

A first end frame member slot is formed on the first end frame member that receives and connects to a second side rail first tab formed on the second side rail. A first end frame member first slot on the first end frame member configured to receive a first side rail first tab on the first side rail. A second end frame member first slot is formed on the second end frame member that is configured to receive the first side rail second tab formed on the first side rail. A second end frame member second slot is formed on the second end frame member configured to receive the second side rail second tab formed on the second side rail.

The light panel retrofit system also preferably has a second panel footing also formed as a pair of footing supports, namely a right second panel footing support and a left second panel footing support. The Second panel footing is connected to the LED panel frame and configured to rest upon a top surface of the LED panel support frame. The power supply is mounted to an upper surface of the LED panel.

A pair of supporting rails are preferably mounted to an upper surface of the LED panel, namely a first supporting rail and a second supporting rail. The first panel footing is rigidly attached to the first supporting rail and to the second supporting rail.

The LED panel latches to the first end frame member as well as the second end frame member via latch connections comprising a latch hook that swivels to engage a latch hook slot. A securing means includes a first retainer line having a first retainer clip and a second retainer line having a second retainer clip. The first end frame member and the second end frame member both have a pivot rail that has a pivot pin receiver. The panel is also connected to the first end frame member and second end frame member by a pivot pin that fits into a pivot pin receiver.

A swivel support is mounted the LED panel underside, and the swivel support is configured to protrude from the LED panel underside when the swivel support is rotated to an engaged position so that a swivel support protrusion is configured to rest on an existing T bar when deployed.

The following call out list of elements can be a useful guide in referencing the elements of the drawings.

20 LED Panel
21 LED Panel Lens
22 LED Panel Frame
23 LED Panel Under Side
24 First End Frame Member
25 Second Send Frame Member
26 First Side Rail
27 Second Side Rail
28 Decommissioned Troffer Frame
29 T Bar
31 First End Frame Member Slot
32 Second Side Rail First Tab
33 First End Frame Member First Slot
34 First Side Rail First Tab
35 Second End Frame Member First Slot
36 First Side Rail Second Tab
37 Second End Frame Member Second Slot
38 Second Side Rail Second Tab
41 Power Supply
42 LED Panel Top Side
43 First Supporting Rail
44 Second Supporting Rail
45 Power Cords
46 Power Cord Connector
50 LED Panel Support Frame
51 First Panel Footing
52 Second Panel Footing
53 Third Panel Footing
54 Right First Panel Footing Support
55 Left First Panel Footing Support
56 LED Panel Support Frame Top Surface
57 Swivel Support
58 Swivel Support Extension
59 Swivel Pin
61 First Retainer Line
62 Second Retainer Line
63 First Retainer Clip
64 Second Retainer Clip
70 Pivot Pin
71 Pivot Opening
72 First Pivot Slot
73 First Pivot Pin Insert Opening
77 Pivot Rail
78 First Mounting Bracket
79 Second Mounting Bracket
74 Second Pivot Opening
75 Second Pivot Slot
76 Second Pivot Pin Insert Opening
81 Latch Hook
82 Latch Hook Slot

DETAILED DESCRIPTION OF THE PREFERRED EMBODIMENT

Figure 1:
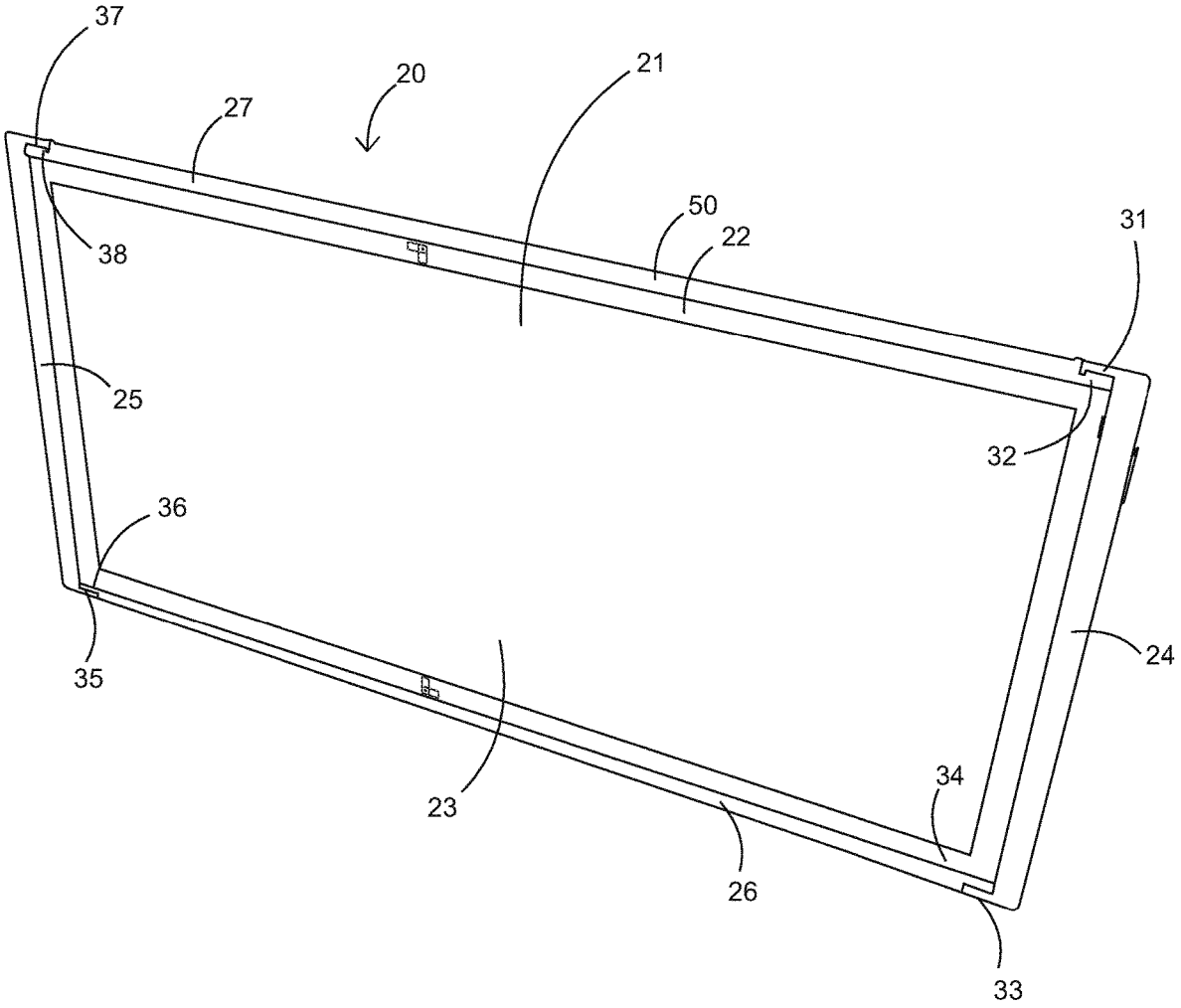
FIG. 1 is a bottom view of the present invention.

As seen in FIG. 1, the LED panel 20 has LED panel lens 21 and an LED panel frame 22. The panel frame 22 is rectangular and supported by a support frame. The LED panel 20 has an LED panel under side 23. The LED panel support frame 50 includes a first end frame member 24 as well as a second end frame member 25. The LED panel 20 support frame has a first side rail 26 and a second side rail 27 that connects the first end frame member to the second end frame member. The side rails are connected to the end frame members by slotting slot and tab connection. The support frame is flat which allows it to fit between the existing troffer and the existing T-bar.

The LED panel 20 is flat and can fit into existing troffers having a low clearance. Sometimes, a variety of different pre-existing rails or ballast covers formed of bent steel members. Thus, LED panels are well-suited for retrofitting traditional florescent lighting structures as the LED panels can be made thinner and flatter than the available hollow area of a traditional florescent lighting structure. The LED panel 20 has structural interconnections so that it can be built with minimal disturbance of the pre-existing troffer above.

The first end frame member slot 31 on the first end frame member 24 receives and connects to the second side rail first tab 32 on the second side rail 27. Similarly, the first end frame member first slot 33 on the first end frame member 24, receives the first side rail first tab 34 on the first side rail 26. The second end frame member first slot 35 on the second end frame member 25 receives the first side rail second tab 36 formed on the first side rail 26. Also, the second end frame member second slot 37 on the second end frame member 25 receives the second side rail second tab 38 on the second side rail 27.

Figure 2:
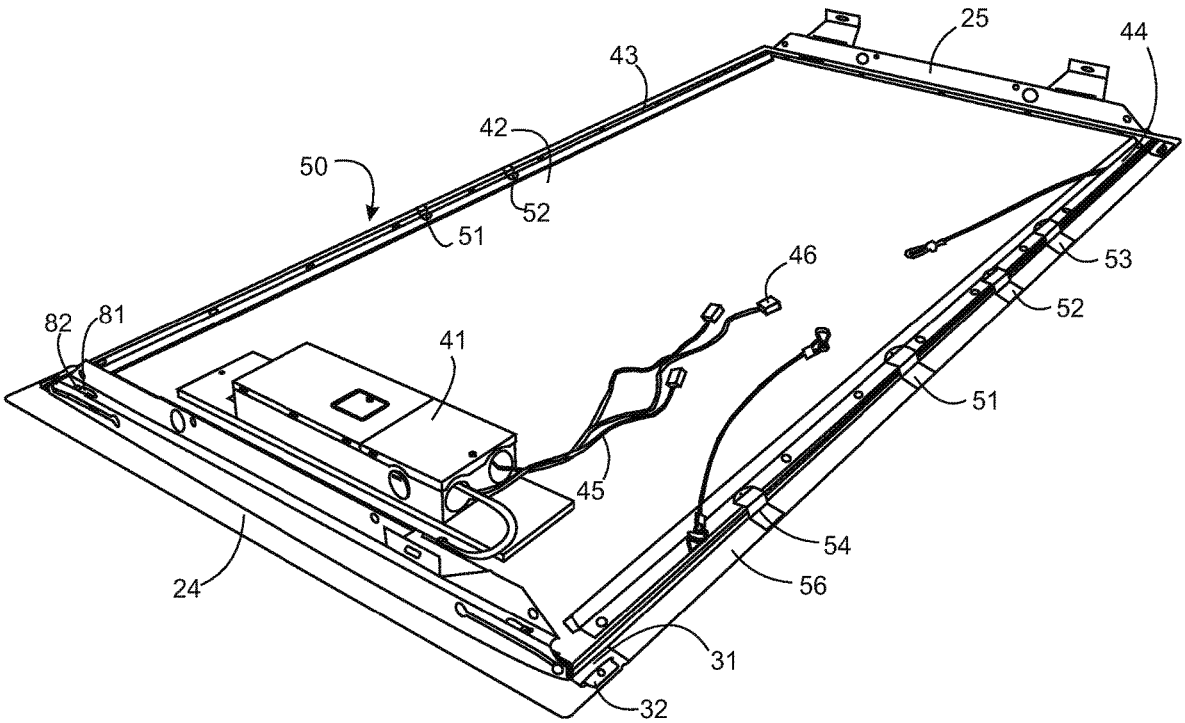
FIG. 2 is a top view of the present invention.

As seen in FIG. 2, the first end frame member 24 opposes the second send frame member 25. The second side rail first tab 32 protrudes distally to engage the first end frame member slot 31. The power supply 41 is mounted to the LED panel top side 42 and has a separate housing and electrical connectors and leads. The first supporting rail 43 and the second supporting rail 44 optionally add improved rigidity and stability. The power cords 45 transmit power via the power cord connectors 46.

The panel has one or more footings that are rigidly attached to the panel and press down on the first side rail 26 and the second side rail 27. The first side rail 26 and the second side rail 27 rest on the long portion of the existing grid track of a drop ceiling. The footings can include a first panel footing 51, a second panel footing 52 opposite the first panel footing 51, and a third panel footing 53 adjacent to the first panel footing 51. The footings can also include a fourth panel footing 54 adjacent to the first panel footing 51. Each of the footings sit on a side rail of a support frame which in turn sits on the existing track support and is weighed down by the decommissioned florescent troffer.

The LED panel 20 latches to the first end frame member 24 as well as the second end frame member 25. Each latch mechanism has a latch hook 81 that swivels to engage a latch hook slot 82.

Figure 3:
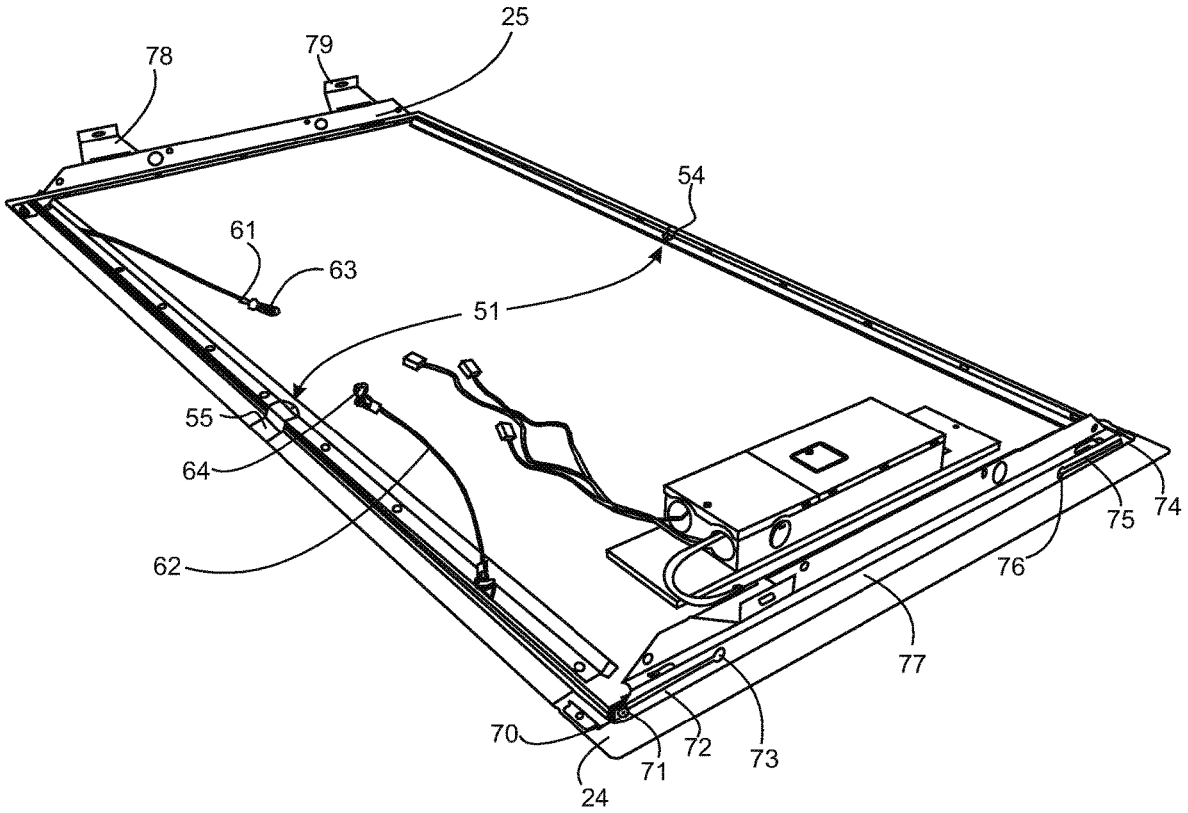
FIG. 3 is another top view of the present invention.

As seen in FIG. 3, the first end frame member 24 and the second send frame member 25 have the latch mechanism with the latch hook 81 engaging the latch hook slot 82. Before the latch mechanisms can be engaged, the panel is preferably secured to outside structure by a first retainer line 61 having a first retainer clip 63 and a second retainer line 62 having a second retainer clip 64.

The first end frame member 24 and second end frame member 25 both have a pivot rail 77 that has a pivot pin receiver. The panel is also connected to the first end frame member 24 and second end frame member 25 by a pivot pin 70 that fits into a pivot pin receiver. The pin receiver is a first pivot pin insert opening 73 or second pivot pin insert opening 76. The first pivot pin insert opening 73 is opposite the second pivot pin insert opening 76. The pivot pin 70 then slides along the first pivot slot 72, or the second pivot slot 75 until it rests at the second pivot opening 74. The pivot rail 77 further includes a first mounting bracket 78 and a second mounting bracket 79 extending upwardly from the pivot rail 77. The first mounting bracket 78 and the second mounting bracket 79 allow for improved connection and optional built-in installation.

Figure 4:
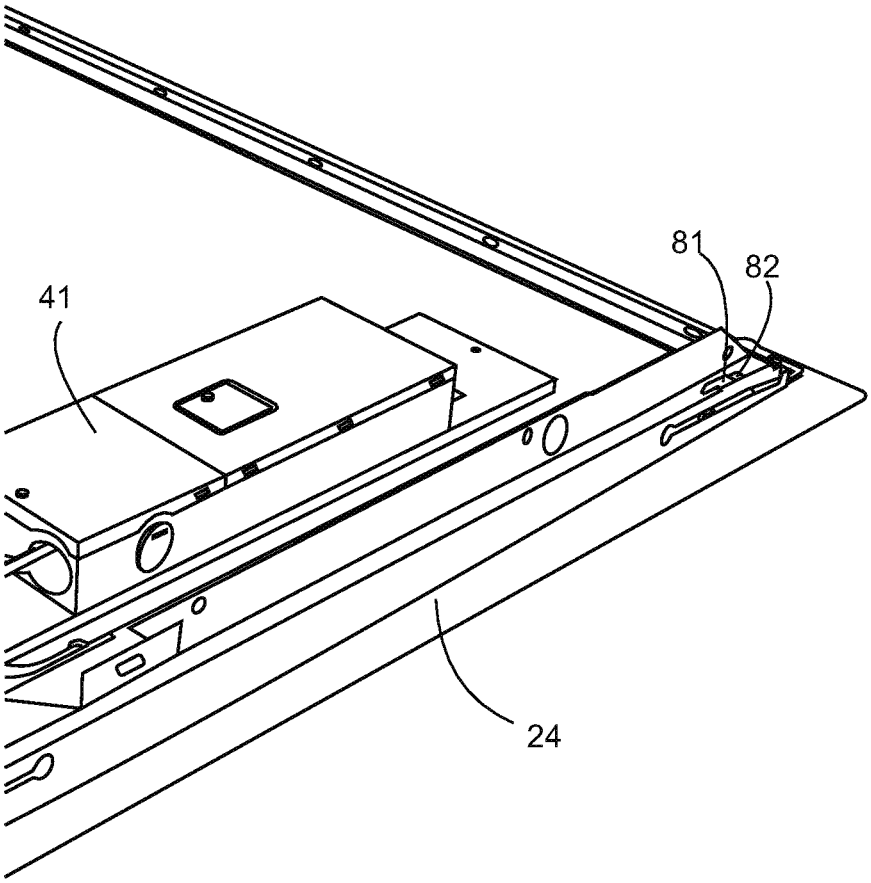
FIG. 4 is a zoom in view of the present invention showing the hook detail.

In FIG. 4, the power supply 41 is shown as a low-profile housing next to the first end frame member 24. On the first end frame member, the latch hook slot 82 receives the latch hook 81 that is mounted to the LED panel 20.

Figure 5:
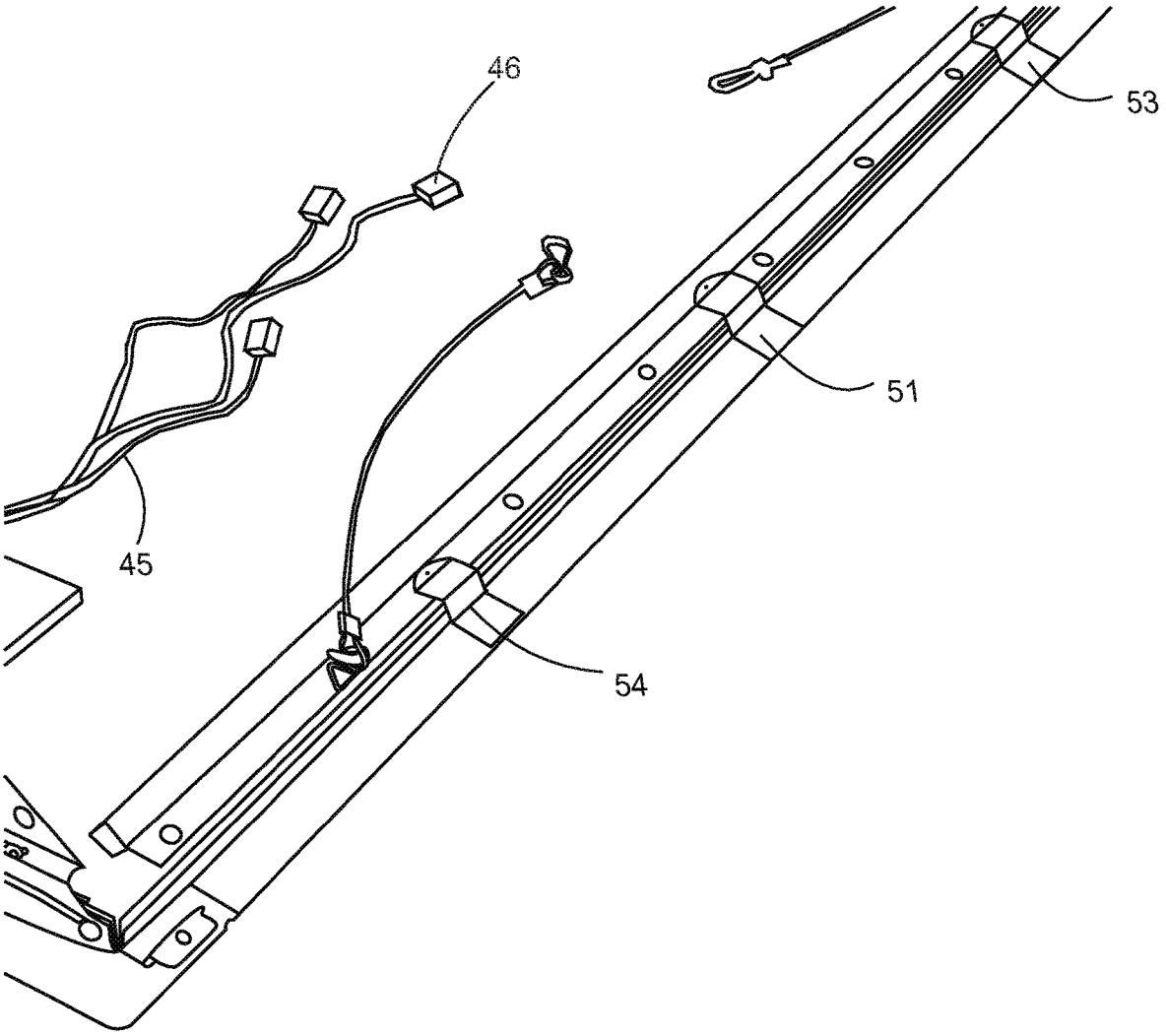
FIG. 5 is a zoom in view of the present invention showing the retainer tab.

As seen in FIG. 5, the first panel footing 51, third panel footing 53 and the fourth panel footing 54, are both shown as attached to an edge of the LED panel so that a footing portion abuts the side rails and prevents warping of the flat LED panel. The power cords 45 and the power cord connector 46 are preferably of standard construction.

The first panel footing 51 as seen in FIG. 3 is preferably formed as a pair of footing supports, namely a first panel footing pair 51 formed of a right first panel footing support 54 and a left first panel footing support 55. As seen in FIG. 3, the LED panel support frame top surface 56 is elongated and flat for inserting between the existing T-bar 29 and obsolete decommissioned florescent troffer frame. Accordingly, the panel footings are also flat tabs that insert between the existing T-bar and decommissioned troffer frame 28.

Figure 6:
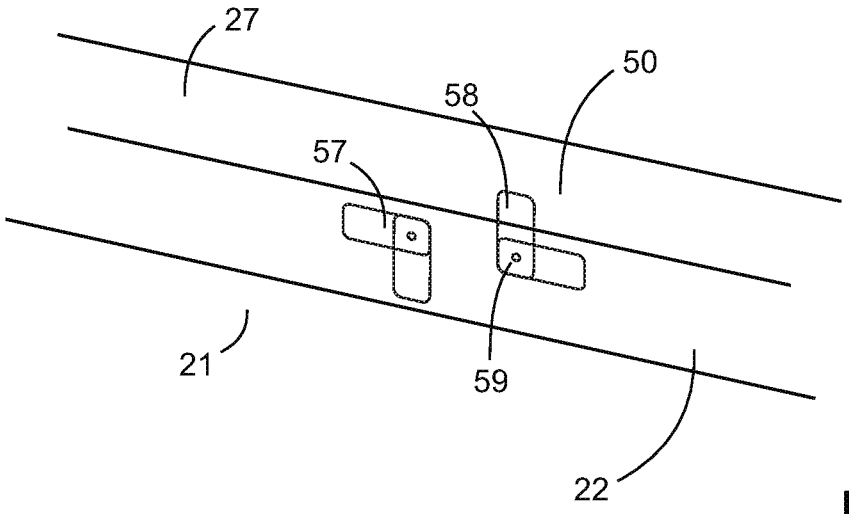
FIG. 6 is a zoom in view of the present invention showing the swivel retainer tab.
Figure 7:
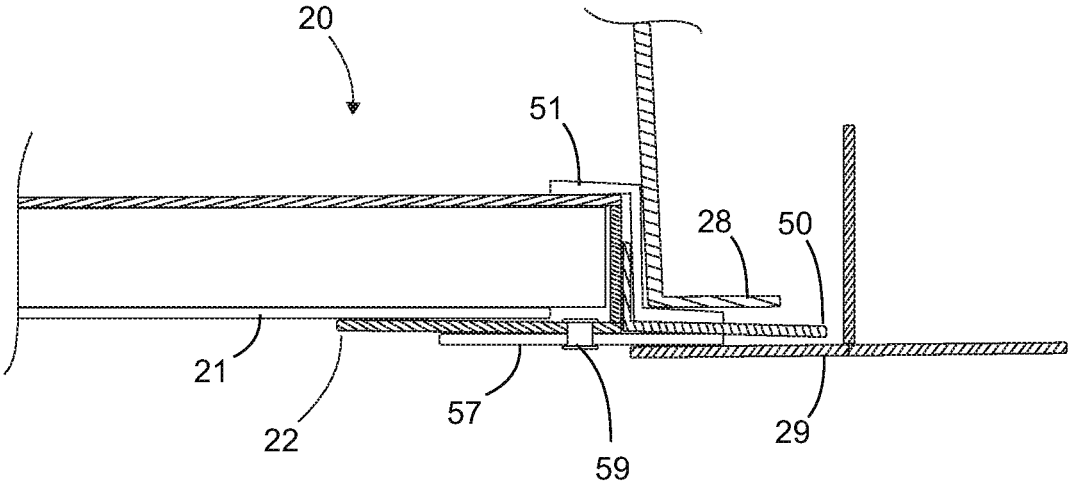
FIG. 7 is a side cross section showing the retainer tab and panel footing insertion.

As seen in FIG. 6, 7 the decommissioned troffer frame 28 rests on the first panel footing 51, which in turn rests on the LED panel support frame 50 which in turn rests on the T-bar 29 and the swivel support 57. The swivel support 57 has a swivel support extension that fits above the T-bar 29 and rests on the T-bar 29. The swivel support extension 58 extends away from a swivel pin 59. The swivel support 57 swivels on the swivel pin 59. The swivel pin 59 can be formed as a rivet attached on the LED panel frame 22. As seen in FIG. 6, a pair of swivel supports can be mounted to the underside of the LED panel frame 22. The swivel support on the right is engaged and the swivel support on the left is disengaged. A swivel support 57 in the disengaged position can be rotated to an engaged position. Optionally, the swivel support 57 can be used without the fixed first panel footing 51 or the fixed first panel footing 51 can be used with the swivel support 57. Optionally, both can be used.

The invention claimed is:

1. A light panel retrofit system comprising:

an LED panel defining an LED panel underside and having an LED panel lens, and an LED panel frame circumscribing the LED panel lens;

a power supply mounted to the LED panel, and supplying power to the LED panel;

an LED panel support frame configured to support the LED panel frame, the LED panel support frame further having first and second end frame members, and first and second side rails, the pair of side rails connecting the and members to each other;

a swivel support mounted to the LED panel underside and configured to be rotated to an engaged position projecting laterally from the LED panel frame, wherein the swivel support includes a swivel support protrusion configured to be rotated to a position projecting laterally from the LED panel frame; and a right first panel footing support and a left first panel footing support, wherein the first panel footing supports are connected to the LED panel frame and configured to rest upon a top surface of the LED panel support frame.

2. The light panel retrofit system of claim 1, further including a right second panel footing support and a left second panel footing support, the second panel footing supports are connected to the LED panel frame and configured to rest upon a top surface of the LED panel support frame.

3. The light panel retrofit system of claim 2, further including a first supporting rail and a second supporting rail mounted to an upper surface of the LED panel, wherein the first panel footing supports are rigidly attached to the first supporting rail and to the second supporting rail.

4. The light panel retrofit system of claim 3, further comprising a slot and tab connecting the side rails to the end frame members.

5. The light panel retrofit system of claim 3, further including a first end frame member slot formed on the first end frame member that receives and connects to a second side rail first tab formed on the second side rail, and further including a first end frame member first slot on the first end frame member configured to receive a first side rail first tab on the first side rail.

6. The light panel retrofit system of claim 3, further including a second end frame member first slot formed on the second end frame member that is configured to receive the first side rail second tab formed on the first side rail.

7. The light panel retrofit system of claim 3, further including a second end frame member second slot formed on the second end frame member configured to receive the second side rail second tab formed on the second side rail.

8. The light panel retrofit system of claim 3, wherein the power supply is mounted to an upper surface of the LED panel.

9. The light panel retrofit system of claim 3, further comprising latch connections having a latch hook that swivels to engage the end frame members to support the LED panel, wherein the latch hook is configured to be rotated to a position projecting laterally from the LED panel.

10. The light panel retrofit system of claim 3, further including a first retainer line having a first retainer clip and a second retainer line having a second retainer clip.

* * * * *